US010723414B1

(12) United States Patent
Small

(10) Patent No.: US 10,723,414 B1
(45) Date of Patent: Jul. 28, 2020

(54) UNIVERSAL SIZED ACCESSORY PLATFORM MOUNT ATTACHABLE TO A BOAT'S T-TOP

(71) Applicant: Cody Small, Vernon, FL (US)

(72) Inventor: Cody Small, Vernon, FL (US)

( * ) Notice: Subject to any disclaimer, the term of this patent is extended or adjusted under 35 U.S.C. 154(b) by 0 days.

(21) Appl. No.: 16/372,277

(22) Filed: Apr. 1, 2019

(51) Int. Cl.
*B63B 17/02* (2006.01)

(52) U.S. Cl.
CPC ..... *B63B 17/02* (2013.01)

(58) Field of Classification Search
CPC ..... B63B 17/02; B63B 17/00; B63B 25/00; B63B 25/02; B60R 9/08; B60R 9/045; B60R 9/052
USPC ..... 224/319, 320
See application file for complete search history.

(56) References Cited

U.S. PATENT DOCUMENTS 5,458,079 A * 10/1995 Matthews ..... B63B 17/02 114/351
5,918,613 A 7/1999 Larson
5,931,114 A 8/1999 Bartholomew
6,257,261 B1 * 7/2001 Johnson ..... B63B 25/00 135/96
6,349,666 B1 * 2/2002 Hastings ..... B63B 17/02 114/361
6,425,508 B1 * 7/2002 Cole ..... B60R 9/045 224/320
6,691,637 B1 2/2004 Smith et al.
6,725,799 B2 4/2004 Tull
6,988,461 B1 1/2006 James
7,306,193 B2 12/2007 Slatter et al.
7,401,569 B2 * 7/2008 Jones ..... B63B 17/02 114/361
8,281,732 B1 10/2012 Irvine
8,365,969 B2 * 2/2013 Johnson ..... B60R 9/08 190/14
9,096,291 B2 8/2015 Perosino et al.
9,827,915 B1 * 11/2017 Chappell ..... B60R 9/045
2001/0006037 A1 * 7/2001 Badley ..... B63B 34/67 114/253
2002/0053313 A1 * 5/2002 Murphy ..... B63B 17/02 114/361
2008/0022916 A1 1/2008 Borges et al.
2008/0223280 A1 * 9/2008 Kemmer ..... B63B 17/02 114/361

* cited by examiner

*Primary Examiner* — Corey N Skurdal
(74) *Attorney, Agent, or Firm* — Peter Loffler

(57) ABSTRACT

A universal fit accessory platform mount uses a pair of coextensive base legs with extensions slidably disposed within either end of the base legs. The extensions have tube clamps on a distal end thereof, the clamps attached to the t-top of a boat. Each extension is slid within the base legs so that its tube clamps align with a leg of the boat's t-top and each extension is attached to the t-top via the tube clamps. Once the extensions are attached and the accessory platform that is attached to the base legs is centered, the base legs are locked to the extensions to prevent sliding movement of the extensions with respect to the base legs.

10 Claims, 4 Drawing Sheets

UNIVERSAL SIZED ACCESSORY PLATFORM MOUNT ATTACHABLE TO A BOAT'S T-TOP

BACKGROUND OF THE INVENTION

1. Field of the Invention

The present invention relates to a platform mount upon which various accessories such as a fold down crow's nest, a radar mount, a rod holder, etc., are themselves mounted, the platform mountable to be sized to fit onto any width of boat t-top.

2. Background of the Prior Art

Boat owners that have a boat configured with a t-top often desire to mount an accessory atop the t-top. Such accessories include a fold down crow's nest, a radar mount, a rod holder, and other similar type of devices. In order to install such accessories, a platform is attached to the t-top and the accessory is attached to the platform in appropriate fashion. In order to install the platform, the boat owner takes the boat to an appropriate shop, hopefully a shop that is located on the water so that the boat does not have to be trailered in, but many boat owners are not so lucky. Technicians at the shop take measurements of the t-top and thereafter build a custom platform mount that is able to fit onto the t-top of that particular boat. Such custom measuring and manufacturing is necessary due to the fact that there is no uniform standard sizes for t-top widths. Boats come in a variety of sizes so that the larger the boat, the greater the width of the t-top on the boat. Even within a given size of a boat, the width of the t-top on the boat varies from manufacturer to manufacturer and often within the same manufacturer for different models of boats. This requires that each platform be custom sized for the boat at hand. Once the measurements are made, the tubing for the platform is cut and welded together and thereafter installed on the boat.

Such custom manufacturing of the platform is time-consuming so that the boat owner is without boat for an extended period of time, possibly weeks depending on the time of year and how busy the shop is at the time. While a pleasure boater may find such delay inconvenient, a charter boat captain may find such delay downright painful as being without a boat means being without a revenue stream from that boat.

What is needed is an accessory platform that is attachable to a boat's t-top, which accessory platform resolves the above stated shortcomings found in the art. Specifically, such an accessory platform must be able to fit atop a wide variety oft-tops that having differing widths so that custom measurement and manufacturing of the accessory platform is not required for a particular boat. Such an accessory platform must be relatively simple to install and maintain atop the t-top.

SUMMARY OF THE INVENTION

The universal sized accessory platform mount attachable to a boat's t-top of the present invention addresses the aforementioned needs in the art by providing an accessory platform upon which appropriate accessories such as a fold down crow's nest, a radar mount, a rod holder, etc., can be attached, the universal sized accessory platform mount attachable to a boat's t-top being able to be quickly and easily sized to fit almost any width oft-top, thereby eliminating the need for custom sizing and manufacturing of the accessory platform mount to fit a given boat. The universal sized accessory platform mount attachable to a boat's t-top is of simple design and construction, being produced using standard manufacturing techniques, so that the device is relatively inexpensive to produce so as to be economically attractive to potential consumers for this type of device. The universal sized accessory platform mount attachable to a boat's t-top is easy to size, install onto the t-top and remove therefrom when use of the accessory platform is not desired or to move the accessory platform mount to a different boat that may have a t-top with a different width relative to the original boat upon which the universal sized accessory platform mount attachable to a boat's t-top is installed.

The universal sized accessory platform mount attachable to a boat's t-top of the present invention is comprised of a pair of hollow tubular base legs that each have a first end and an opposing second end. A first series of longitudinal, spaced apart slits is disposed within each base leg at the first end thereof forming a series of first fingers while a second series of longitudinal, spaced apart slits is disposed within each base leg at the second end thereof forming a series of second fingers. A first extension has a pair of first extension legs, each first extension leg having a first straight section curving into a downwardly depending first end section. Each of the pair of the first extension legs is partially received within the a respective one of the base legs through the first end and capable of sliding within the base leg. A second extension has a pair of second extension legs, each second extension leg having a second straight section curving into a downwardly depending second end section. Each of the pair of the second extension legs is partially received within the a respective one of the base legs through the second end and capable of sliding within the base leg. Each of the first end sections is attached to a first side of the t-top and each of the second end sections is attached to a second side of the t-top such that the first extension and the second extension are each slide within the base legs so as to be sized width wise to accommodate the width between the first side of the t-top and the second side of the t-top. An accessory platform of any desired design is attached to each of the base legs in appropriate fashion. Each of the first end sections is attached to the first side of the t-top via a first tube clamp of any appropriate design and each of the second end sections is attached to the second side of the t-top via a second tube clamp of any appropriate design. A first pair of shaft clamps is provided such that each first clamp encircles the first fingers of a respective one of the base legs while a second pair of shaft clamps is provided and each second clamp encircles the second fingers of a respective one of the base legs. Each first clamp is tightened so that it cinches about its respective first fingers and presses the first fingers into frictional engagement with the first straight section of the first extension leg disposed within that respective base leg. Each second clamp is tightened so that it cinches about its respective second fingers and presses the second fingers into frictional engagement with the second straight section of the second extension leg disposed within that respective base leg.

BRIEF DESCRIPTION OF THE DRAWINGS

Similar reference numerals refer to similar parts throughout the several views of the drawings.

DESCRIPTION OF THE PREFERRED EMBODIMENT

Figure 1:
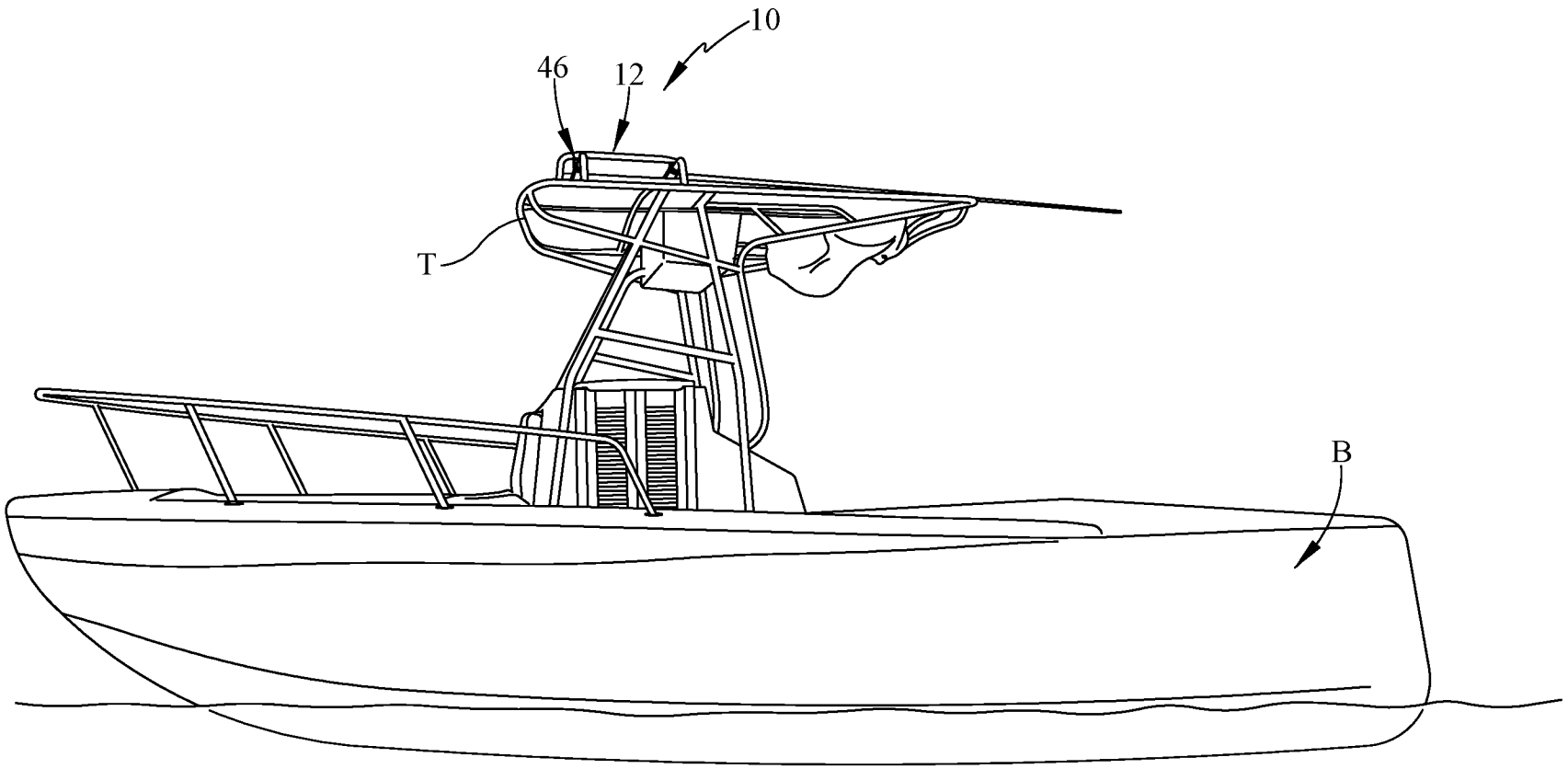
FIG. 1 is an environmental view of the universal sized accessory platform mount attachable to a boat's t-top of the present invention.
Figure 2:
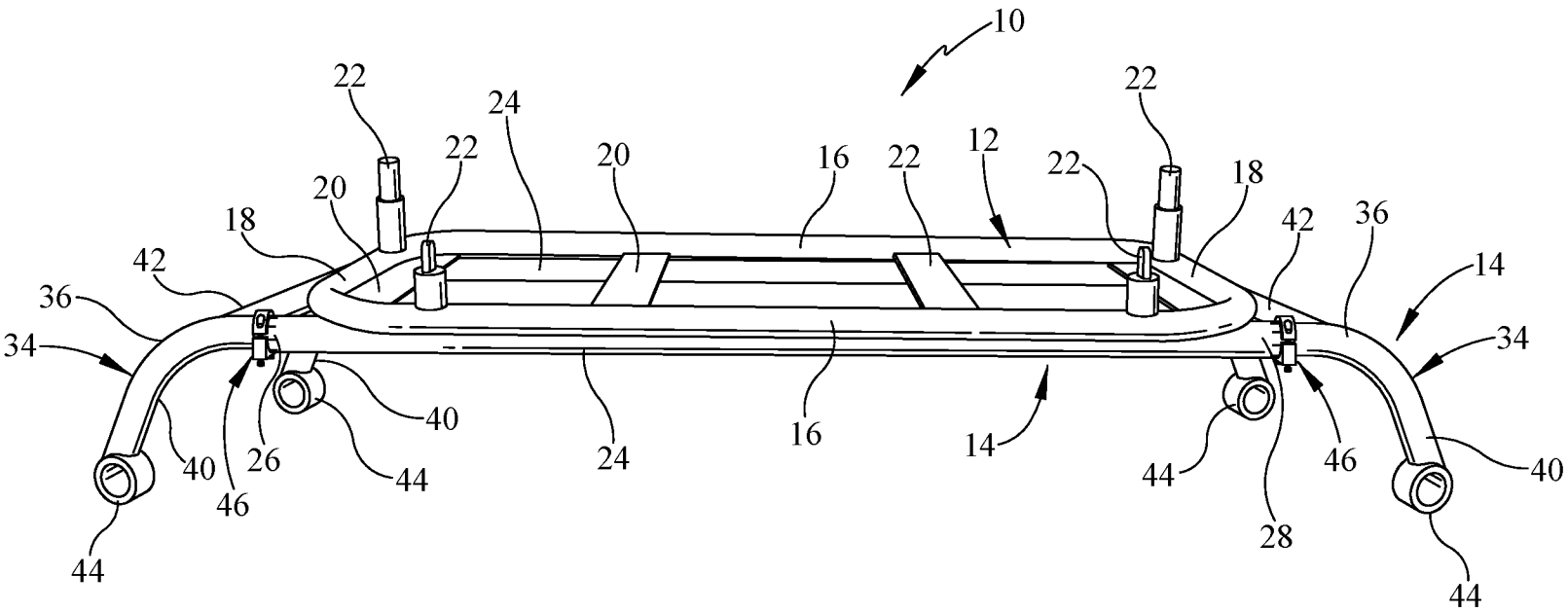
FIG. 2 is a perspective view of the universal sized accessory platform mount attachable to a boat's t-top in a narrow fit, retracted position.
Figure 3:
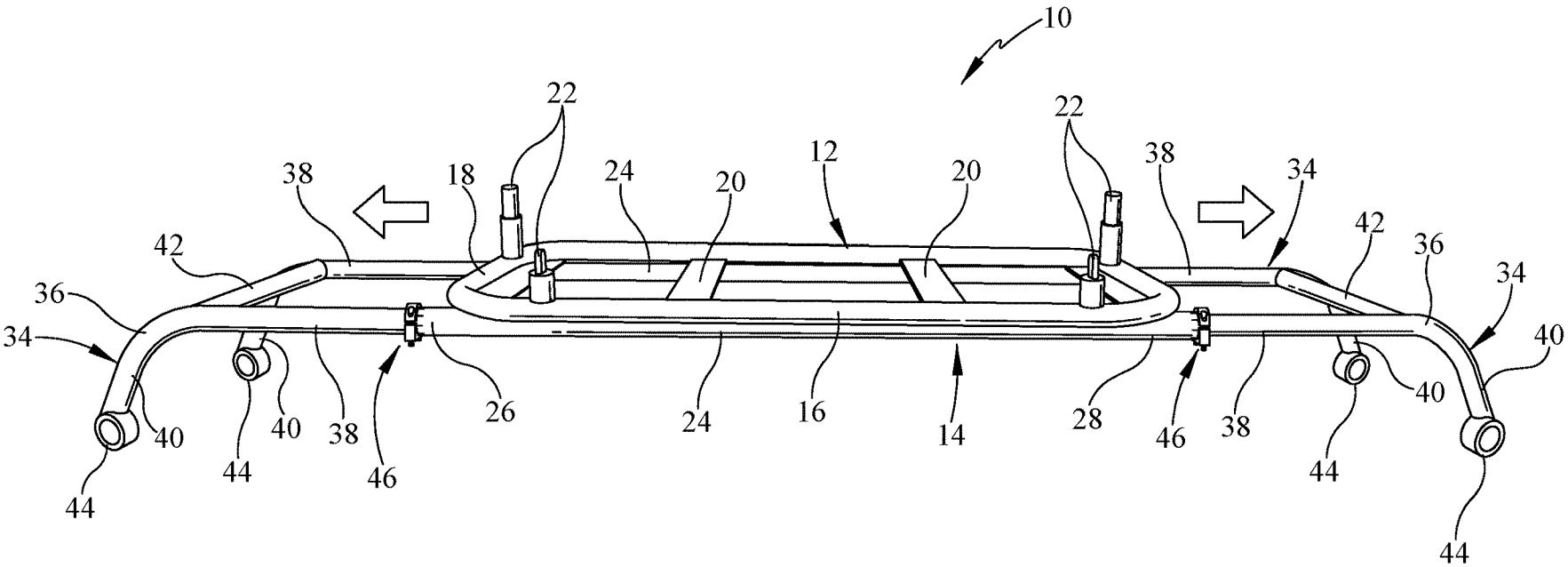
FIG. 3 is a perspective view of the universal sized accessory platform mount attachable to a boat's t-top in a wide fit, extended position.
Figure 4:
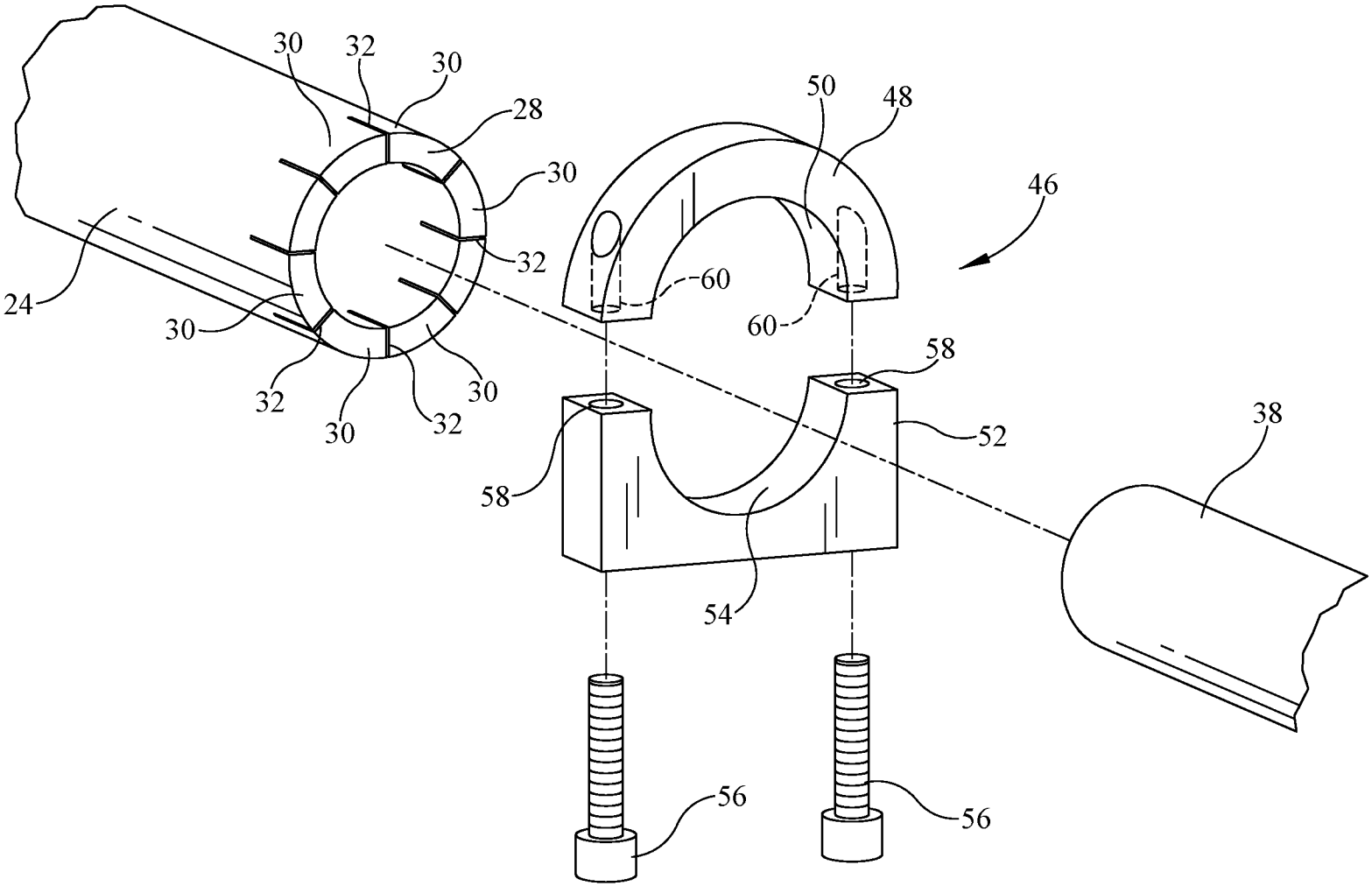
FIG. 4 is a close-up view of the shaft clamp used with the universal sized accessory platform mount attachable to a boat's t-top used to hold the accessory platform mount in a desired width of expansion.

Referring now to the drawings, it is seen that the universal sized accessory platform mount attachable to a boat's t-top of the present invention, generally denoted by reference numeral 10, is comprised of an accessory platform 12 seated atop a mount system 14.

As seen, the accessory platform 12 is of any desired architecture appropriate for mounting atop a t-top T of a boat B, and has a base with a pair of longitudinal legs 16 joined by a pair of latitudinal legs 18 and possibly one or more brace legs 20. Extending upwardly from the longitudinal legs 16, the latitudinal legs 18 or both are accessory mounts 22 of desired configurations. Of course, the accessory platform 12 shown is by way of example and the accessory platform may have a different architecture than the one illustrated.

As seen, the mount system 14 is comprised of a pair of coextensive and parallel base legs 24 that each have a first end 26 and an opposing second end 28, the base legs 24 being hollow tubular members. Each first end 26 and each second end 28 of the base legs 24 has a series of "fingers" 30 located there at, the fingers 30 being formed by a series of spaced apart longitudinal slits 32 made in each of the ends 26 and 28 of the base leg 24, such fingers 30 being capable of flexing slightly inwardly when appropriate cinching pressure is placed thereon as more fully discussed below.

A pair of extensions 34 is provided. Each extension 34 has a pair of extension legs 36 that each have a straight section 38 that curves into a downwardly depending end section 40. Each pair of extension legs 36 is joined by a connector leg 42 proximate the curved portion thereof. The extension legs 36 are tubular members that are sized to snugly fit and be capable of sliding within the base legs 24. A tube clamp 44 of any appropriate design is located on the distal end of the end section 40 of each extension leg 36.

The entire mount system 14, including the base legs 24 and the extensions 34 are made from an appropriate material designed for use in a water borne environment, such as aircraft aluminum.

Four shaft clamps 46 are provided and each has an upper section 48 with a first arcuate inner surface 50 and a lower section 52 with a second arcuate inner surface 54, the radius of curvature of the first inner surface 50 and the second inner surface 54 dimensioned to match the radius of curvature of the outer surface of the base leg 24 at the fingers 30 thereof. A pair of bolts 56 is provided and each threadably passes through a threaded channel 58 on a respective side of the lower section 52 and is received within a threaded boss 60 on the upper section 48. When the bolts 56 are threadably passed through the threaded channel 58 and received within the threaded boss 60, tightening of the bolts 56 draws the upper section 48 toward the lower section 52. The shaft clamps 46 are made from the same or similar material used to make the base legs 24 and extensions 34.

In order to use the universal sized accessory platform mount attachable to a boat's t-top 10 of the present invention, each extension 34 is connected to the pair of base legs 24 by having the straight section 38 of each extension leg 36 received within a respective one of the base legs 24. The universal sized accessory platform mount attachable to a boat's t-top 10 is positioned so that the tube clamps 44 of each extension 34 align with a respective leg of the t-top T and the tube clamps 44 are attached to the t-top T in appropriate fashion. In so sizing, each extension 34 is slid within the base legs 24 in order to have the universal sized accessory platform mount attachable to a boat's t-top 10 at the proper width of expansion so that corresponding tube clamps 44 on opposing extensions 34 are each overtop their respective leg of the t-top T. Each extension 34 is positioned at the same level of disposition within the base legs 24 so that the universal sized accessory platform mount attachable to a boat's t-top 10 and its platform 12 are centered. If desired, appropriate markings (not illustrated) can be located on at least one of the extension legs 36 of each extension 34 to assist with device centering. Once the extensions 34 are attached to the t-top T and the base legs 24 and thus the accessory platform 12 are centered, the base legs 24 are locked in position via the shaft clamps 46 by having the upper section 48 and lower section 52 of each shaft clamp 46 encircle its respective end 26 or 28 of the base leg 24 at the fingers 30 thereof. The bolts 56 are passed through the threaded channel 58 of the lower section 52 and into the threaded boss 60 of the upper section 48 thereby drawing the upper section 48 toward the lower section 52. With sufficient tightening of the bolts 56, the upper section 48 and lower section 52 cinch about the fingers 30 and press the fingers 30 toward the base leg 24 so that the fingers 30 frictionally engage the base leg 24 to the point that the extensions 34 are no longer free to slide within the base legs 24.

Of course, other systems can be used to hold the extensions 34 in a fixed position with respect to the base legs 24 such as passing set screws (not illustrated) through the base legs 24 and frictionally engaging the straight sections 38 of the extension legs 36 or received such set screws can be received within openings (not illustrated) within the straight sections 38 of the extension legs 36, etc.

While the invention has been particularly shown and described with reference to an embodiment thereof, it will be appreciated by those skilled in the art that various changes in form and detail may be made without departing from the spirit and scope of the invention.

I claim:

1. A platform mount for a t-top of a boat, the platform mount comprising:

a pair of hollow tubular base legs, each base leg having a first end and an opposing second end;

a first extension having a pair of first extension legs, each first extension leg having a first straight section and a downwardly depending first end section, each of the pair of the first extension legs partially received within a respective one of the base legs through the first end and capable of sliding therein;

a second extension having a pair of second extension legs, each second extension leg having a second straight section and a downwardly depending second end section, each of the pair of the second extension legs partially received within a respective one of the base legs through the second end and capable of sliding thereon; and wherein each of the first end sections is adapted to attach to a first side of the t-top and each of the second end sections is adapted to attach to a second side of the t-top such that the first extension and the second extension each slide within the base legs to accommodate a width between the first side of the t-top and the second side of the t-top.

2. The platform mount as in claim 1 further comprising an accessory platform attached to each of the base legs.

3. The platform mount as in claim 1 wherein each of the first end sections is attached to the first side of the t-top via a first tube clamp and each of the second end sections is attached to the second side of the t-top via a second tube clamp.

4. The platform mount as in claim 1 further comprising lock means for holding both the first extension and the second section in fixed positions with respect to the base legs.

5. The platform mount as in claim 1 further comprising:

a first connector leg having a third end attached to a respective one of the first extension legs and a fourth end attached to the other of the first extension legs; and a second connector leg having a fifth end attached to a respective one of the second extension legs and a sixth end attached to the other of the second connector legs.

6. A platform mount for a t-top of a boat, the platform mount comprising:

a pair of hollow tubular base legs, each base leg having a first end and an opposing second end such that a series of longitudinal, spaced apart first slits is disposed within each base leg at the first end thereof forming a series of first fingers and a series of longitudinal, spaced apart second slits is disposed within each base leg at the second end thereof forming a series of second fingers;

a first extension having a pair of first extension legs, each first extension leg having a first straight section and a downwardly depending first end section, each of the pair of the first extension legs partially received within a respective one of the base legs through the first end and capable of sliding thereon;

a second extension having a pair of second extension legs, each second extension leg having a second straight section and a downwardly depending second end section, each of the pair of the second extension legs partially received within a respective one of the base legs through the second end and capable of sliding thereon; and wherein each of the first end sections is adapted to attach to a first side of the t-top and each of the second end sections is adapted to attach to a second side of the t-top such that the first extension and the second extension each slide within the base legs to accommodate a width between the first side of the t-top and the second side of the t-top.

7. The platform mount as in claim 6 further comprising an accessory platform attached to each of the base legs.

8. The platform mount as in claim 6 wherein each of the first end sections is attached to the first side of the t-top via a first tube clamp and each of the second end sections is attached to the second side of the t-top via a second tube clamp.

9. The platform mount as in claim 6 further comprising:

a pair of first shaft clamps, each first shaft clamp encircling the first fingers of a respective one of the base legs;

a pair of second shaft clamps, each second shaft clamp encircling the second fingers of a respective one of the base legs; and wherein when each first shaft clamp is tightened, the first shaft clamp cinches about its respective first fingers and presses the first fingers into frictional engagement with the first straight section of the first extension leg disposed within that respective base leg and when each second shaft clamp is tightened, the second shaft clamp cinches about its respective second fingers and presses the second fingers into frictional engagement with the second straight section of the second extension leg disposed within that respective base leg.

10. The platform mount as in claim 6 further comprising:

a first connector leg having a third end attached to a respective on of the first extension legs and a fourth end attached to the other of the first extension legs; and a second connector leg having a fifth end attached to a respective on of the second extension legs and a sixth end attached to the other of the second connector legs.

* * * * *